United States Patent [19]

Johnson

[11] 4,115,722

[45] Sep. 19, 1978

[54] CORONA-SHIELD FOR AN IMAGE-TUBE PHOTOCATHODE

[75] Inventor: Charles Bruce Johnson, Fort Wayne, Ind.

[73] Assignee: International Telephone and Telegraph Corporation, Nutley, N.J.

[21] Appl. No.: 810,122

[22] Filed: Jun. 27, 1977

[51] Int. Cl.[2] ..... H01J 19/78

[52] U.S. Cl. ..... 315/52; 315/58; 250/213 VT; 313/94; 313/242; 313/313

[58] Field of Search ..... 250/213 VT; 313/240, 313/242, 94; 315/52, 58

[56] References Cited

U.S. PATENT DOCUMENTS

| | | | |
|---|---|---|---|
| 3,728,573 | 4/1973 | Roeber | 313/242 X |
| 4,000,432 | 12/1976 | Coon et al. | 313/242 |

*Primary Examiner*—Alfred E. Smith
*Assistant Examiner*—Charles F. Roberts
*Attorney, Agent, or Firm*—John T. O'Halloran; Alfred C. Hill

[57] ABSTRACT

A hollow cylindrical member composed of a high-voltage potting material is secured adjacent the photocathode to the high-voltage potting material encircling the image-tube. The hollow member is concentric with the axis of the tube and extends away from the photocathode. A plurality of equally spaced metallic discs are embedded in the potting material of the corona-shield interconnected by a plurality of resistors. A high-voltage is coupled to one of the metallic discs adjacent the photocathode and a ground is coupled to another of the metallic discs most remote from the photocathode.

6 Claims, 1 Drawing Figure

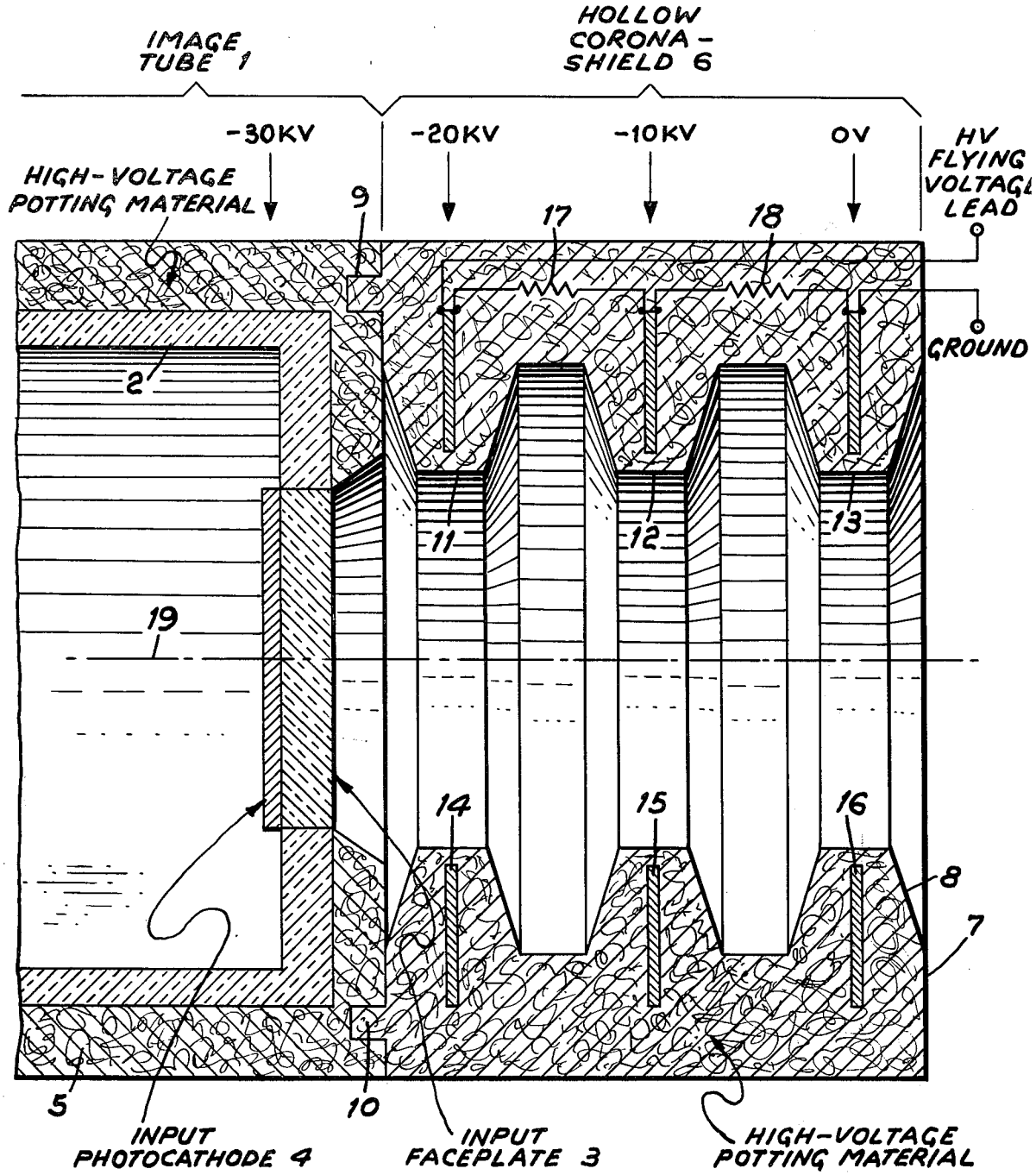
IMAGE TUBE 1
HOLLOW CORONA-SHIELD 6
-30KV
-20KV
-10KV
0V
HV FLYING VOLTAGE LEAD
HIGH-VOLTAGE POTTING MATERIAL
9
17
18
GROUND
2
11
12
13
19
14
15
16
8
7
5
10
INPUT PHOTOCATHODE 4
INPUT FACEPLATE 3
HIGH-VOLTAGE POTTING MATERIAL

CORONA-SHIELD FOR AN IMAGE-TUBE PHOTOCATHODE

BACKGROUND OF THE INVENTION

This invention relates to corona-shields and more particularly to a corona-shield for an image-tube photocathode.

It is often necessary to take special precautions to insure that corona discharges do not occur near the input photocathode of multi-stage image converter tubes. For example, approximately −30 kV (kilovolts) is applied to the input photocathode of a two-stage magnetically focused image-tube, while the output phosphor screen and focus magnet are held at ground (zero voltage). The electric field strength in the region between the input photocathode and its surrounding assembly is commonly large enough to produce corona discharge, even if the image-tube is "potted" with high-voltage silicone rubber and encased in an insulating cylinder.

SUMMARY OF THE INVENTION

This invention relates to an improved corona-shield for an image-tube photocathode.

A feature of the present invention is the provision of a corona-shield for an image-tube photocathode, the tube having an input faceplate adjacent the photocathode and an image-tube envelope encased in a first high voltage potting material comprising: a hollow cylindrical member composed of a second high voltage potting material secured adjacent the photocathode to the first potting material, the hollow member is concentric with the axis of the tube and extends away from the photocathode; a plurality of equally spaced metallic discs embedded in the second potting material interconnected by a plurality of resistors; a high voltage coupled to one of the metallic discs adjacent the photocathode; and ground coupled to another of the metallic discs most remote from the photocathode.

BRIEF DESCRIPTION OF THE DRAWING

Above-mentioned and other features and objects of this invention will become more apparent by reference to the following description taken in conjunction with the accompanying drawing, in which the single FIGURE is a cross-sectional view of the corona-shield in accordance with the principles of the present invention.

DESCRIPTION OF THE PREFERRED EMBODIMENT

Image-tube 1 includes an envelope 2 containing therein an input faceplate 3 where envelope 2 and faceplate 3 maintain a vacuum environment for the input photocathode 4 and the remainder of the elements of tube 1. Envelope 2 is encased in a high-voltage potting material 5.

The hollow corona-shield 6 includes a hollow cylindrical member 7 composed of a high-voltage potting material 8 which is secured to the high-voltage potting material 5 at the notch 9 into which a projection 10 of member 7 is inserted. Material 5 and material 8 are secured at notch 9 and projection 10 by a molding process.

The inner surface of member 7 contains therein a plurality of equally spaced projections 11, 12 and 13 having a frustrum configuration. These frustrum projections 11–13 extend inwardly to the extent that they do not block impinging light on faceplate 3 and photocathode 4. Each of metallic discs 14–16 extend into a different one of the projections 11–13 and are interconnected by a plurality of resistors, such as resistors 17 and 18. High-voltage is applied to disc 14 closest to photocathode 4 and a ground is applied to disc 16 which is the most remote metallic member from the photocathode 4.

The corona-shield 6 provides a long electrical path from the photocathode faceplate 3 to the surrounding grounded focus magnetic assembly and it also insures alignment of the corona-shield with image-tube axis 19.

Corona-shield 6 reduces the electric field strength at the input photocathode 4 to a value well below corona onset. The metallic discs 14–16 in member 7 gradually lower the high potential at the photocathode 4 to ground potential within the length of corona shield 6. Note that the optical bundle into the tube is completely unobstructed by the corona-shield 6. However, it is necessary to allow for the additional length of the corona-shield 6 in the design of a complete sensor system. Corona-shield 6 can also be incorporated into the potting material of a given tube assembly if two separate assemblies are not desirable, or necessary. In this case, the leads to discs 14 and 16 are not necessary, since the required connections can be made directly to the selected image-tube electrodes.

While I have described above the principles of my invention in connection with specific apparatus it is to be clearly understood that this description is made only by way of example and not as a limitation to the scope of my invention as set forth in the objects thereof and in the accompanying claims.

I claim:

1. A corona-shield for an image-tube photocathode, said tube having an input faceplate adjacent said photocathode and an image-tube envelope encased in a first high voltage potting material comprising:

a hollow cylindrical member composed of a second high voltage potting material secured adjacent said photocathode to said first potting material, said hollow member is concentric with the axis of said tube and extends away from said photocathode;

a plurality of equally spaced metallic discs embedded in said second potting material interconnected by a plurality of resistors;

a high voltage coupled to one of said metallic discs adjacent said photocathode; and ground coupled to another of said metallic discs most remote from said photocathode.

2. A corona-shield according to claim 1, wherein the inner surface of said hollow member includes a plurality of equally spaced projections.

3. A corona-shield according to claim 2, wherein each of said metallic discs extend into a different one of said plurality of projections.

4. A corona-shield according to claim 3, wherein said plurality of projections have a frustrum configuration.

5. A corona-shield according to claim 1, wherein the inner surface of said hollow member includes a plurality of equally spaced frustrums extending inwardly toward the axis of said tube to an extent so as to not interfere with light entering said input faceplate.

6. A corona-shield according to claim 5, wherein each of said metallic discs extend into a different one of said plurality of frustrums.

* * * * *